US007611341B2

(12) United States Patent
Byun et al.

(10) Patent No.: US 7,611,341 B2
(45) Date of Patent: Nov. 3, 2009

(54) CAPACITY VARYING TYPE ROTARY COMPRESSOR

(75) Inventors: Sang-Myung Byun, Gyeongsangnam-Do (KR); Kang-Wook Cha, Gyeongsangnam-Do (KR); Seoung-Yeon Cho, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/667,693

(22) PCT Filed: Jan. 2, 2006

(86) PCT No.: PCT/KR2006/000007

§ 371 (c)(1),
(2), (4) Date: May 14, 2007

(87) PCT Pub. No.: WO2006/090978

PCT Pub. Date: Aug. 31, 2006

(65) Prior Publication Data

US 2008/0003123 A1 Jan. 3, 2008

(30) Foreign Application Priority Data

Feb. 23, 2005 (KR) ..... 10-2005-0015127
Feb. 23, 2005 (KR) ..... 10-2005-0015128
Jun. 27, 2005 (KR) ..... 10-2005-0055953
Dec. 29, 2005 (KR) ..... 10-2005-0134568

(51) Int. Cl.
*F03C 2/00* (2006.01)
*F04C 2/00* (2006.01)

(52) U.S. Cl. ..... 418/11; 418/23; 418/60; 418/270; 417/213; 417/440

(58) Field of Classification Search ..... 418/11, 418/23, 60, 63, 270; 417/440, 441, 442, 417/213
See application file for complete search history.

(56) References Cited

U.S. PATENT DOCUMENTS 4,397,618 A * 8/1983 Stenzel ..... 418/23
6,716,007 B2 * 4/2004 Kim et al. ..... 418/23

(Continued)

FOREIGN PATENT DOCUMENTS

JP 56012085 2/1981

(Continued)

OTHER PUBLICATIONS

International Search Report dated May 10, 2006.

*Primary Examiner*—Theresa Trieu
(74) *Attorney, Agent, or Firm*—Ked & Associates LLP

(57) ABSTRACT

A capacity varying rotary compressor is provided. The compressor includes a casing that maintains a discharge pressure state, a motor installed in the casing that generates a driving force, one or more cylinder assemblies provided in the casing to compress refrigerant with a rolling piston and a vane. The rolling piston is eccentrically coupled to a rotation shaft of the motor to perform a linear motion, and a vane restricting device restricts or releases the vane from the rolling piston according to a difference in pressures applied to the vane. A structure of the compressor may be simplified, resulting in reduced production costs and enhanced productivity. Further, as the vane is restricted by a pressure differential, reliability may be enhanced.

6 Claims, 12 Drawing Sheets

U.S. PATENT DOCUMENTS

| | | | | |
|---|---|---|---|---|
| 6,796,773 | B1 * | 9/2004 | Choi et al. | 418/60 |
| 2004/0009083 | A1 | 1/2004 | Kim et al. | |

FOREIGN PATENT DOCUMENTS

| | | | | | |
|---|---|---|---|---|---|
| JP | 58030498 | A * | 2/1983 | | |
| JP | 61175295 | A * | 8/1986 | | 418/23 |
| JP | 2191894 | | 7/1990 | | |
| JP | 10047285 | | 2/1998 | | |

* cited by examiner

CAPACITY VARYING TYPE ROTARY COMPRESSOR

TECHNICAL FIELD

The present invention relates to a rotary compressor, and more particularly, to a capacity varying type rotary compressor capable of restricting or releasing a vane by supplying a suction pressure or a discharge pressure to a lateral surface of a vane slot.

BACKGROUND ART

Generally, an air conditioner serves to maintain an indoor room as a comfortable state by maintaining an indoor temperature as a set temperature. The air conditioner comprises a refrigerating system. The refrigerating system comprises a compressor for compressing a refrigerant, a condenser for condensing a refrigerant compressed by the compressor and emitting heat outwardly, an expansion valve for lowering a pressure of a refrigerant condensed by the condenser, and an evaporator for evaporating a refrigerant that has passed through the expansion valve and absorbing external heat.

In the refrigerating system, when a compressor is operated as power is supplied thereto, a refrigerant of a high temperature and a high pressure discharged from the compressor sequentially passes through the condenser, the expansion valve, and the evaporator, and then is sucked into the compressor. The above process is repeated. In the above process, the condenser generates heat and the evaporator generates cool air by absorbing external heat. The heat generated from the condenser and the cool air generated from the evaporator are selectively circulated into an indoor room, thereby maintaining the indoor room as a comfortable state.

A compressor constituting the refrigerating system is various. Especially, a compressor applied to an air conditioner includes a rotary compressor, a scroll compressor, etc.

The most important factor in fabricating the air conditioner is to minimize a fabrication cost for a product competitiveness and to minimize a power consumption.

In order to minimize a power consumption of the air conditioner, the air conditioner is driven according to a load of an indoor room where the air conditioner is installed, that is, a temperature condition. That is, when the indoor temperature is drastically increased, the air conditioner is in a power mode so as to generate much cool air according to the drastic temperature variance (an excessive load). On the contrary, when the indoor temperature is varied with a small width, the air conditioner is in a saving mode so as to generate less cool air to maintain a preset indoor temperature.

In order to implement the modes, an amount of a refrigerant compressed by the compressor and discharged is controlled thereby to vary a refrigerating capacity of the refrigerating system.

As a method for controlling the amount of a refrigerant discharged from the compressor, an inverter motor is applied to the compressor thereby to vary an rpm of a driving motor of the compressor. An rpm of the driving motor of the compressor is controlled according to a load of an indoor room where the air conditioner is installed, and thus an amount of a refrigerant discharged from the compressor is controlled. An amount of heat generated from the condenser and cool air generated from the evaporator is controlled by varying the amount of a refrigerant discharged from the compressor.

However, in case of applying the inverter motor to the compressor, a fabrication cost is increased due to high price of the inverter motor thereby to degrade a price competitiveness.

Accordingly, a technique for varying a capacity of a compression chamber by partially bypassing a refrigerant compressed in a cylinder of the compressor to outside of the cylinder or a technique for generating an idling by separating a vane from a rolling piston and thus connecting a compression chamber and a suction chamber to each other are being widely researched. However, in the former method, a piping system for bypassing a refrigerant to outside of the cylinder is complicated thereby to increase a flow resistance of the refrigerant and to degrade a cooling efficiency. Also, in the latter method, a magnet or a tension spring is used to restrict the vane to a vane slot, which requires a complicated installation process. Especially, in case of using a magnet, metallic powder of the compressor or the refrigerating system is adhered to the vane thereby to damage a bearing surface.

DISCLOSURE OF THE INVENTION

Therefore, an object of the present invention is to provide a capacity varying type rotary compressor capable of easily restricting a vane separated from a rolling piston at the time of an idling, and capable of enhancing a reliability.

To achieve these and other advantages and in accordance with the purpose of the present invention, as embodied and broadly described herein, there is provided a capacity varying type rotary compressor, comprising: a casing that maintains a discharge pressure state; a motor installed in the casing and generating a driving force; one or more cylinder assembly fixed in the casing and compressing a refrigerant by a rolling piston and a vane, the rolling piston eccentrically coupled to a rotation shaft of the motor and performing an orbit motion, and the vane contacting the rolling piston and performing a linear motion; and a vane restricting unit for restricting the vane separated from the rolling piston or releasing the vane thereby contacting to the rolling piston according to a difference of pressures applied to the vane.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to the preferred embodiments of the present invention, examples of which are illustrated in the accompanying drawings.

Hereinafter, a capacity varying type rotary compressor according to the present invention will be explained in more detail with reference to one embodiment of the attached drawings.

Figure 1:
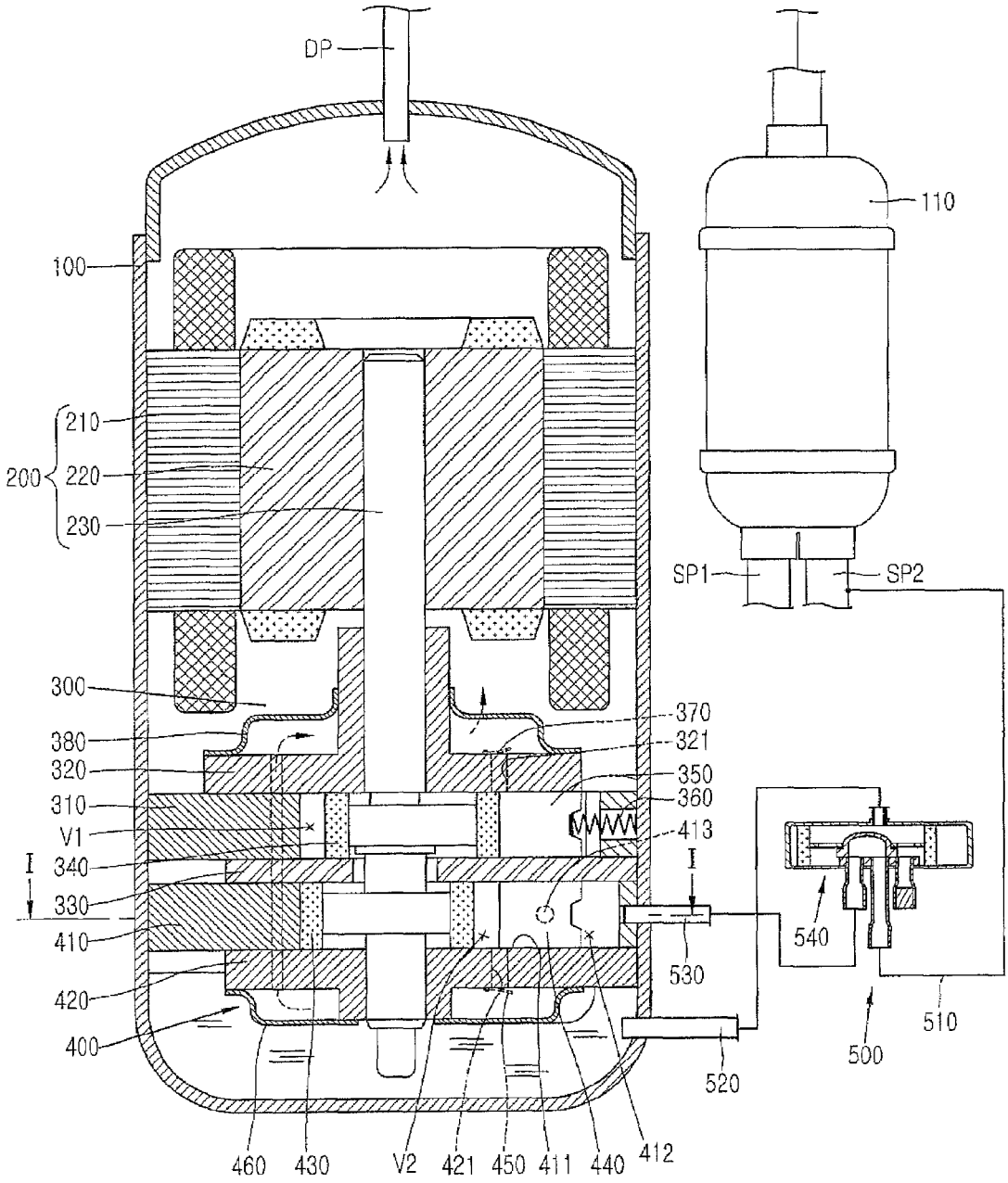
FIG. 1 is a longitudinal section view showing a capacity varying type rotary compressor according to the present invention.
Figure 2:
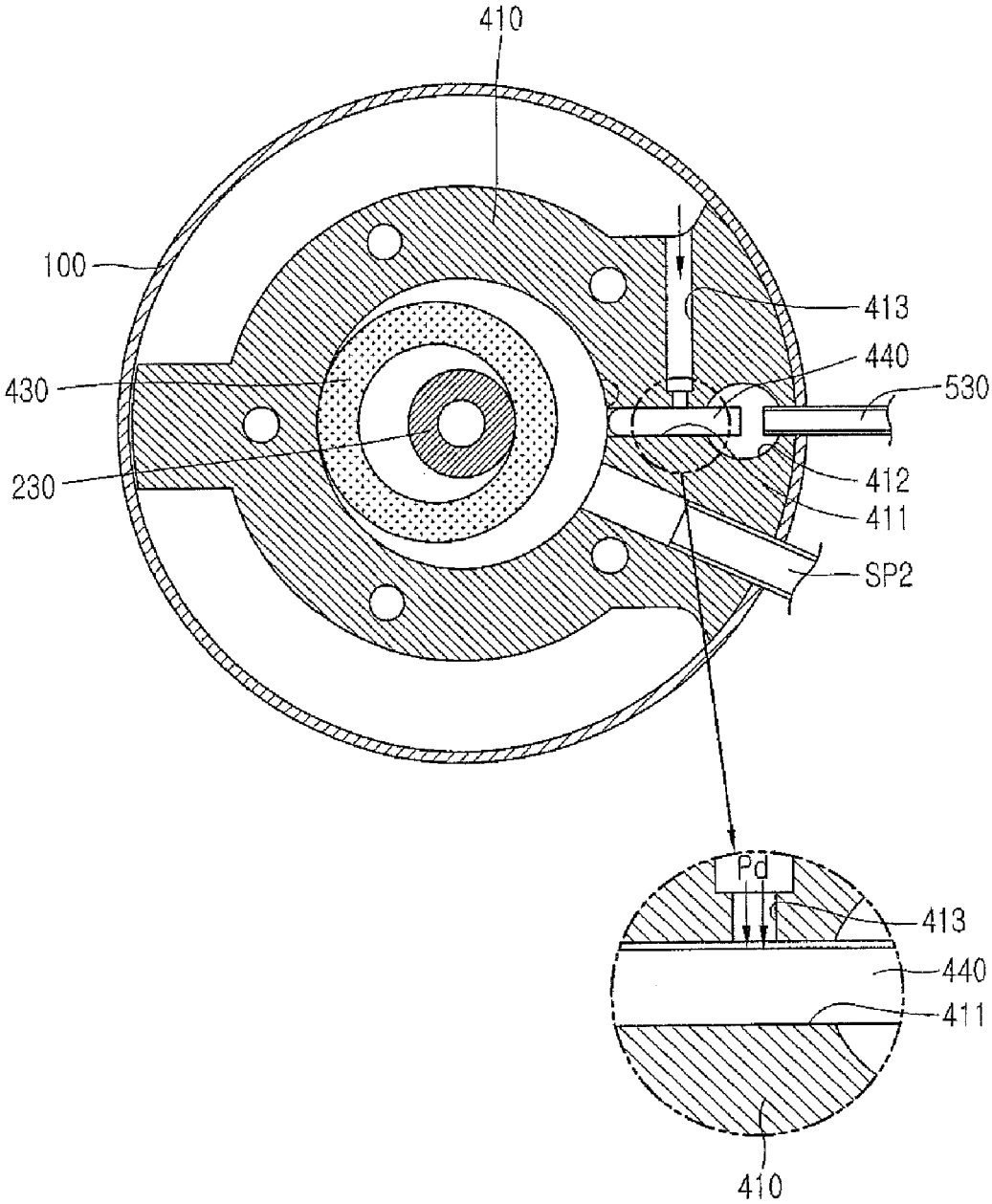
FIG. 2 is a sectional view taken along line 'I-I' of FIG. 1.
Figure 3:
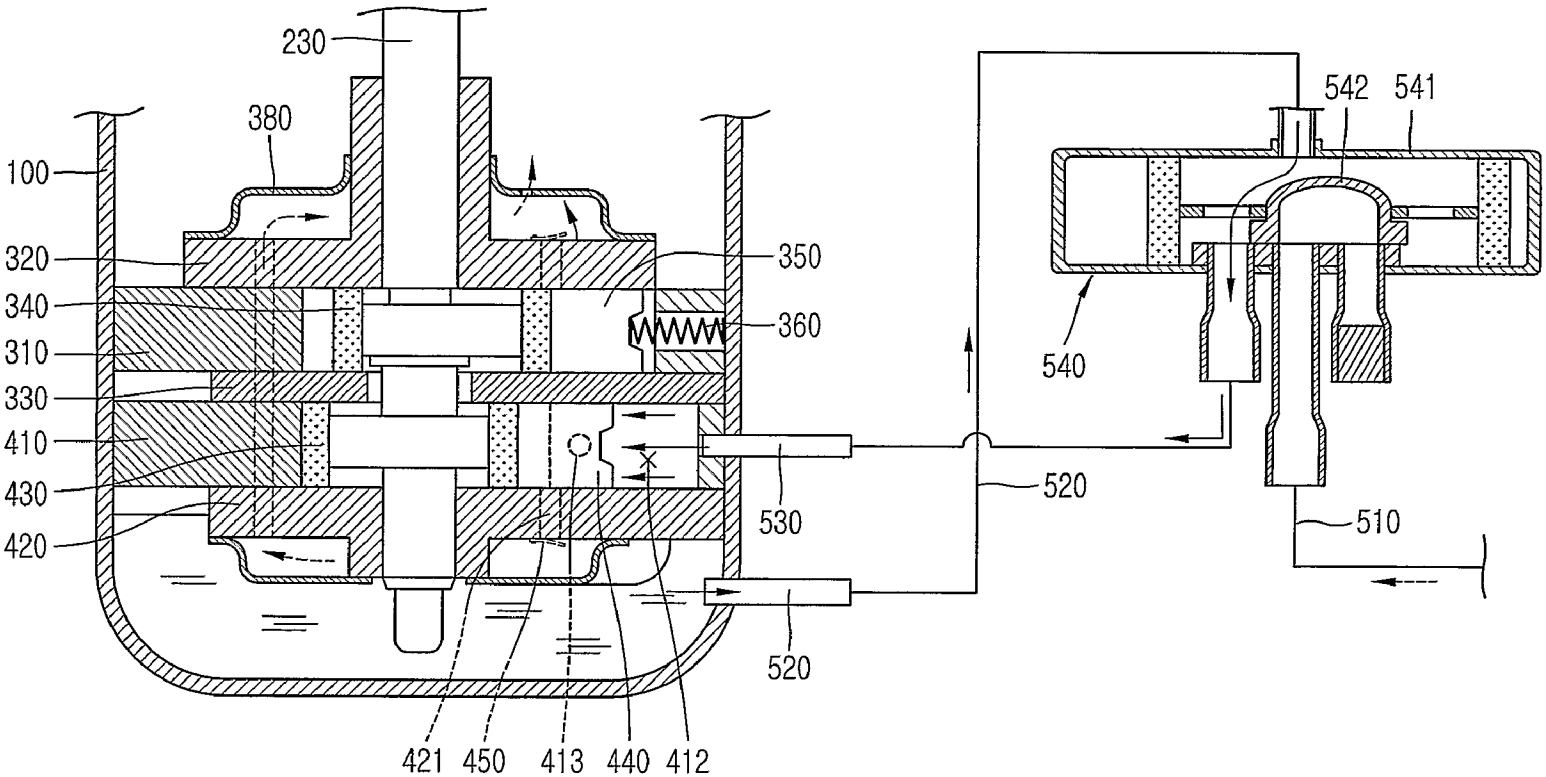
FIGS. 3 and 4 are longitudinal section views showing a normal driving and a saving driving in a first embodiment for restricting a vane of the capacity varying type rotary compressor according to the present invention.
Figure 4:
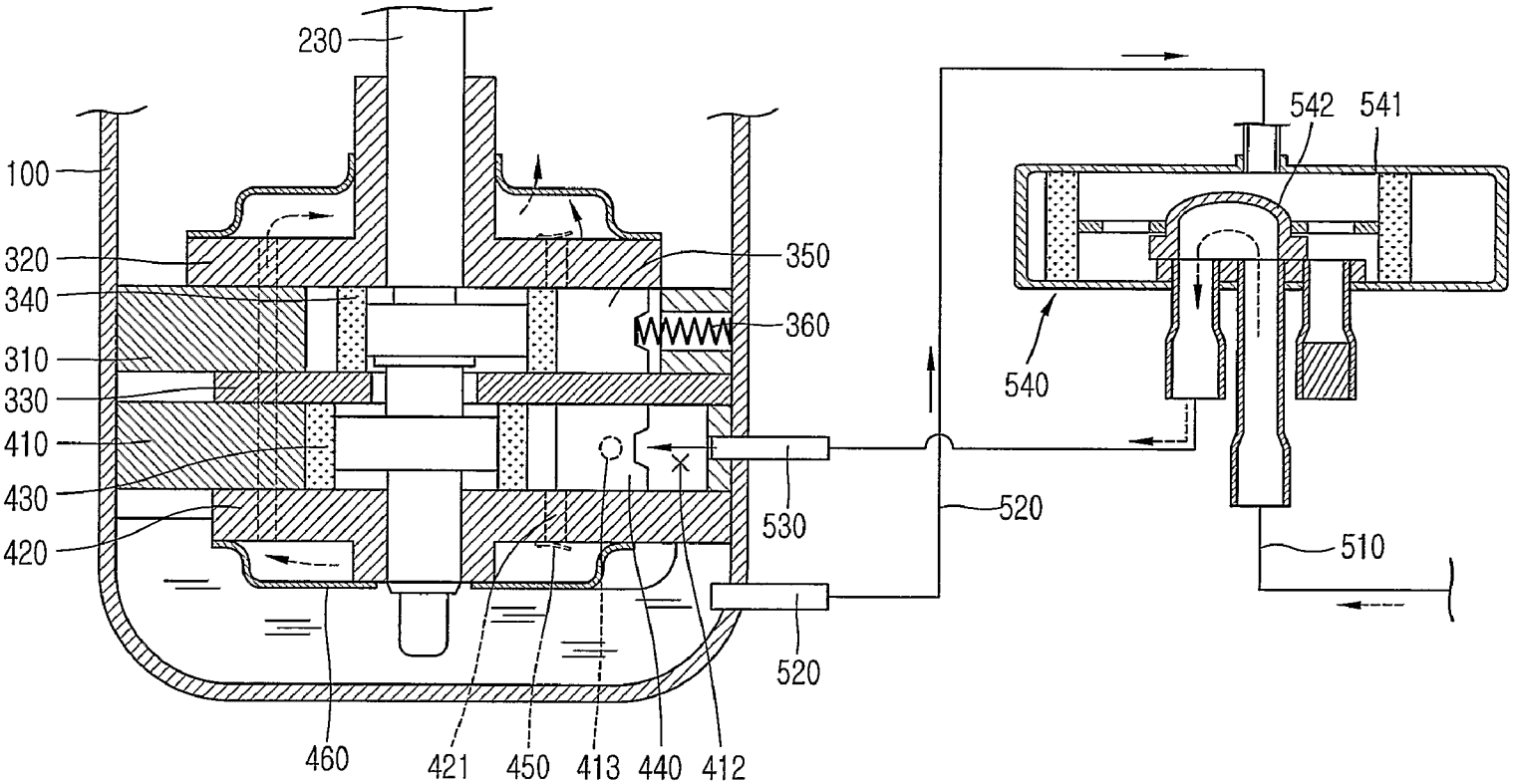
Figure 5:
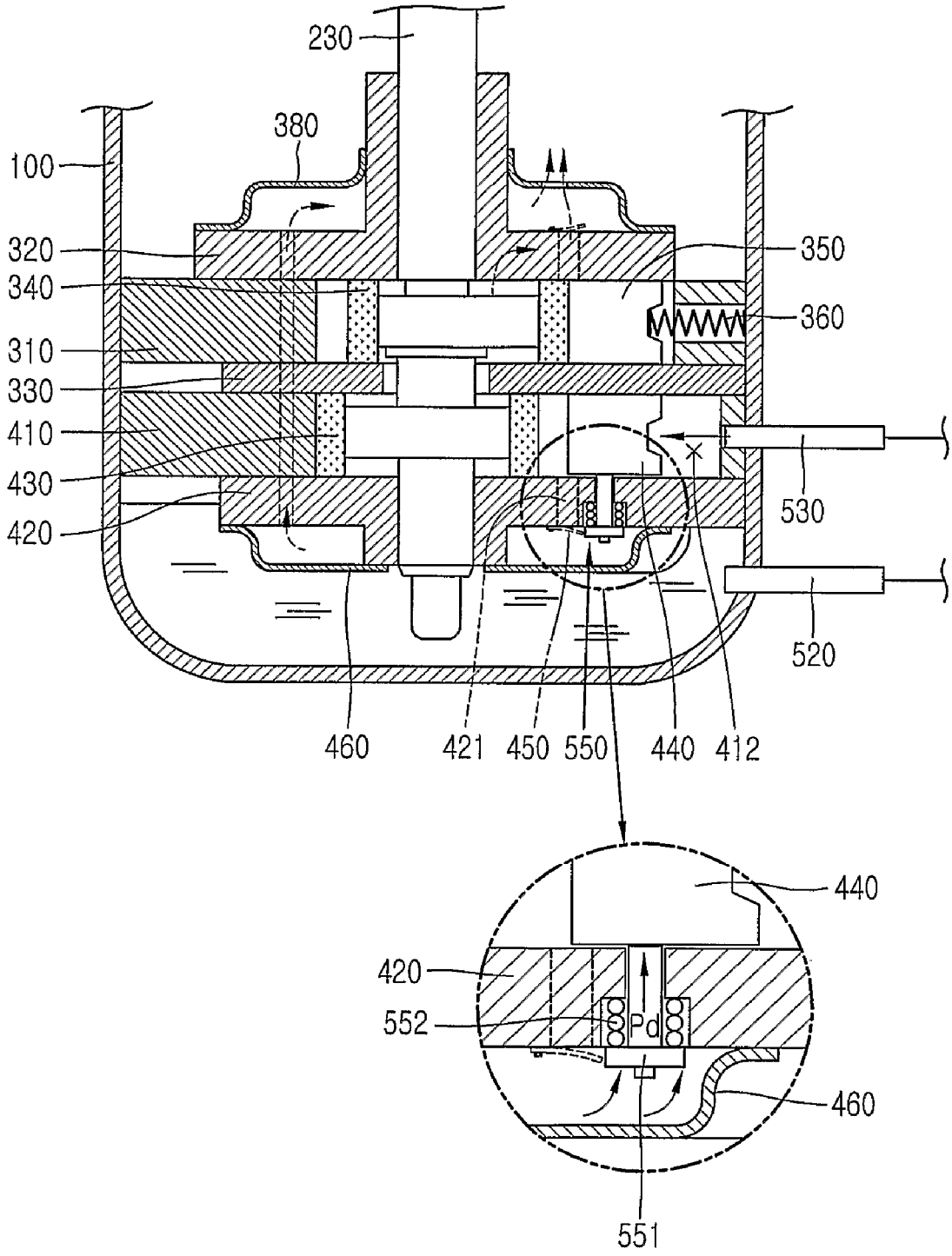
FIG. 5 is a longitudinal section view showing another embodiment for restricting the vane of the capacity varying type rotary compressor according to the present invention.

FIG. 1 is a longitudinal section view showing a capacity varying type rotary compressor according to the present invention, FIG. 2 is a sectional view taken along line 'I-I' of FIG. 1, FIGS. 3 and 4 are longitudinal section views showing a normal driving and a saving driving in a first embodiment for restricting a vane of the capacity varying type rotary compressor according to the present invention, and FIG. 5 is a longitudinal section view showing another embodiment for restricting the vane of the capacity varying type rotary compressor according to the present invention.

As shown in FIG. 1 and FIG. 2, a double type rotary compressor according to the present invention comprises a casing 100 to which a plurality of gas suction pipes SP1 and SP2 and one gas discharge pipe DP are connected, a motor part 200 installed at an upper side of the casing 100 and generating a rotation force, a first compression part 300 and a second compression part 400 installed at a lower side of the casing 100 for compressing a refrigerant by a rotation force generated from the motor part 200, and a vane restricting unit 500 for implementing a normal driving or a saving driving of the second compression part 400 and maintaining a received state of a second vane 440 into a second vane slot 411 when the second compression part 400 performs a saving driving.

The motor part 200 performs a constant speed driving or a variable speed (inverter) driving. The motor part 200 comprises a stator 210 installed in the casing 100 and receiving power applied from outside, a rotor 220 disposed in the stator 210 with a certain air gap and rotated by being interacted with the stator 210, and a rotation shaft 230 coupled to the rotor 220 for transmitting a rotation force to the first compression part 300 and the second compression part 400.

The first compression part 300 comprises a first cylinder 310 having a ring shape and installed in the casing 100, an upper bearing plate 320 (hereinafter, an upper bearing) and a middle bearing plate 330 (hereinafter, a middle bearing) covering upper and lower sides of the first cylinder 310 thereby forming a first compression space (V1) for supporting the rotation shaft 230 in a radial direction, a first rolling piston 340 rotatably coupled to an upper eccentric portion of the rotation shaft 230 and compressing a refrigerant with orbiting in the first compression space V1 of the first cylinder 310, a first vane 350 coupled to the first cylinder 310 to be movable in a radial direction so as to be in contact with an outer circumferential surface of the first rolling piston 340 for dividing the first space V1 of the first cylinder 310 into a first suction chamber and a first compression chamber, a vane supporting spring 360 formed of a compression spring for elastically supporting a rear side of the first vane 350, a first discharge valve 370 openably coupled to an end of a first discharge opening 321 provided in the middle of the upper bearing 320 for controlling a discharge of a refrigerant discharged from the compression chamber of the first compression space V1, and a first muffler 380 having an inner volume to receive the first discharge valve 370 and coupled to the upper bearing 320.

The second compression part 400 comprises a second cylinder 410 having a ring shape and installed at a lower side of the first cylinder 310 inside the casing 100, a middle bearing 330 and a lower bearing plate 420 covering upper and lower sides of the second cylinder 410 thereby forming a second compression space (V2) for supporting the rotation shaft 230 in a radial direction and in a shaft direction, a second rolling piston 430 rotatably coupled to a lower eccentric portion of the rotation shaft 230 and compressing a refrigerant with orbiting in the second compression space V2 of the second cylinder 410, a second vane 440 coupled to the second cylinder 410 to be movable in a radial direction so as to contact/separate to/from an outer circumferential surface of the second rolling piston 430 for dividing the second space V2 of the second cylinder 410 into a second suction chamber and a second compression chamber or connecting the suction chamber and the compression chamber to each other, a second discharge valve 450 openably coupled to an end of a second discharge opening 421 provided in the middle of the lower bearing 420 for controlling a discharge of a refrigerant discharged from the second compression chamber, and a second muffler 460 having an inner volume to receive the second discharge valve 450 and coupled to the lower bearing 420.

As shown in FIG. 2, the second cylinder 410 comprises a second vane slot 411 formed at one side of an inner circumferential surface thereof constituting the second compression space V2 for reciprocating the second vane 440 in a radial direction, a second inlet (not shown) formed at one side of the second vane slot 411 in a radial direction for introducing a refrigerant into the second compression space V2, and a second discharge guiding groove (not shown) inclinably installed in a shaft direction, for discharging a refrigerant into the casing 100. A vane pressure chamber 412 connected to a common side connection pipe 530 of a valve unit 500 that will be later explained for maintaining a rear side of the second vane 440 as a suction pressure atmosphere or a discharge pressure atmosphere is hermetically formed at a rear side of the second vane slot 411 in a radial direction. Also, a vane restricting passage 413 for connecting inside of the casing 100 to the second vane slot 411 in a perpendicular direction or an inclined direction to a motion direction of the second vane 440 and thereby restricting the second vane 440 by a discharge pressure inside the casing 100 is formed at the second cylinder 410.

As shown in FIG. 2, the vane restricting passage 413 is positioned at a discharge guiding groove (not shown) of the second cylinder 410 based on the second vane 440, and is penetratingly formed towards the center of the second vane slot 411 from an outer circumferential surface of the second cylinder 410. The vane restricting channel 413 is formed to have a two-step narrowly formed towards the second vane slot 411 by using a two-step drill. An outlet of the vane restricting passage 413 is formed at an approximate middle part of the second vane slot 411 in a longitudinal direction so that the second vane 440 can perform a stable linear reciprocation. Preferably, a sectional area of the vane restricting passage 413 is equal or narrower to/than a longitudinal sectional area of the second vane slot 411, that is, a sectional area of the rear surface of the second vane 440, thereby preventing the second vane 440 from being excessively restricted. It is also possible that the vane restricting passage 413 is provided in plurality along a height direction of the second vane 440 (in drawing, upper and lower vane restricting passages).

Figure 11A:
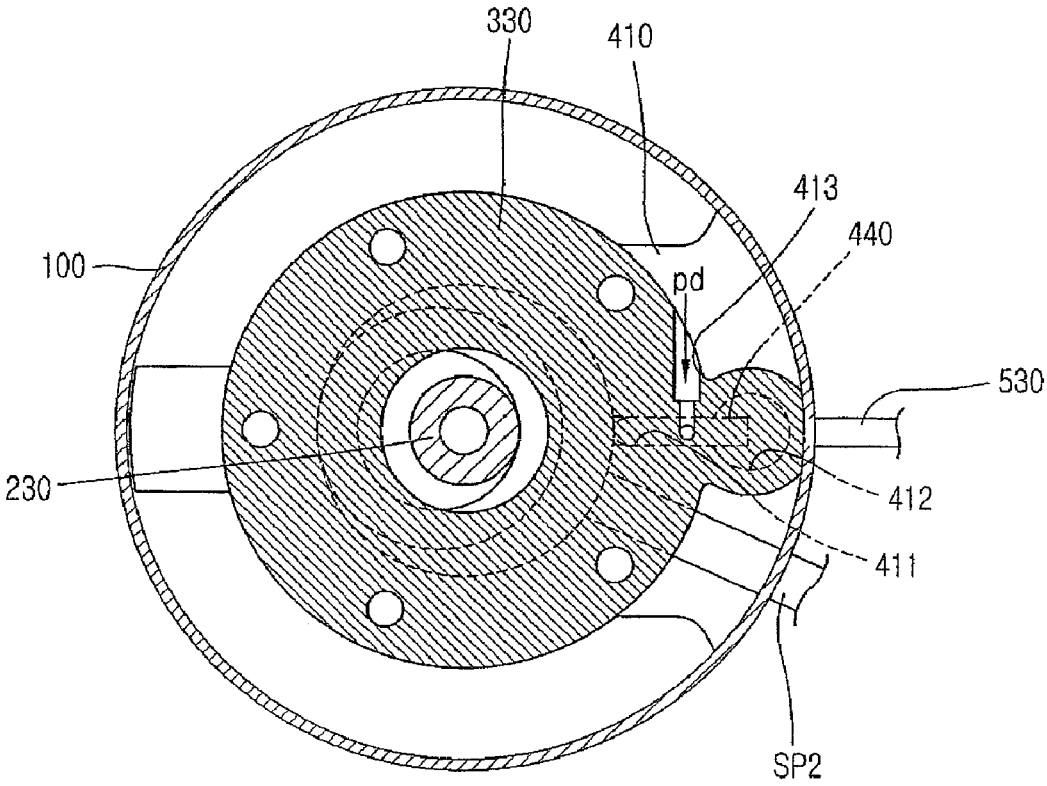
FIGS. 11A and 11B are diagrams showing additional embodiments relating to the location of a vane restricting passage.
Figure 11B:
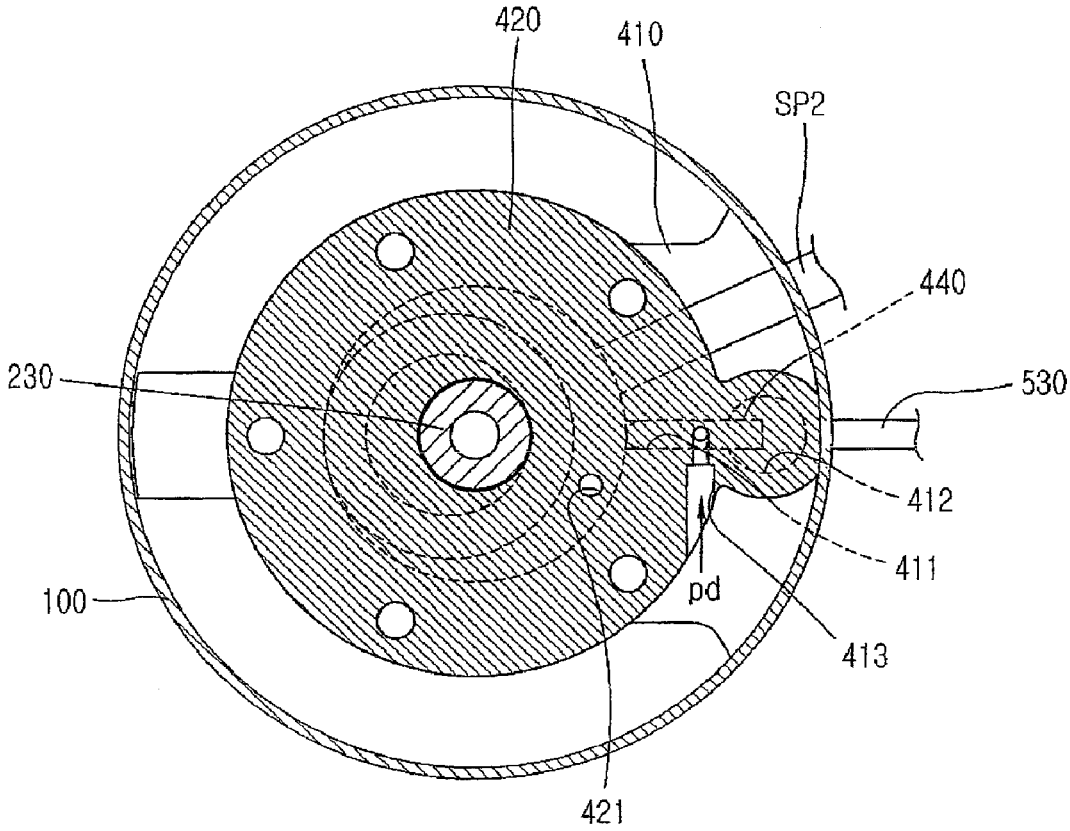

As shown in FIG. 2, the vane restricting passage 413 can be formed at the second cylinder 410 in a horizontal direction so as to correspond to right and left sides of the second vane 440, or can be formed at the middle bearing 330 (FIG. 11A) or the lower bearing 420 (FIG. 11B) in a horizontal direction or in a vertical direction so as to correspond to right and left sides or upper and lower sides of the second vane 440.

The vane restricting unit 500 comprises a suction pressure side connection pipe 510 diverged from a second gas suction pipe SP2, a discharge pressure side connection pipe 520 connected to an inner space of the casing 100, a common side connection pipe 530 connected to the vane pressure chamber 412 of the second cylinder 410 and connected to the suction pressure side connection pipe 510 and the discharge pressure side connection pipe 520, and a pressure switching valve 540 connected to the vane chamber 412 of the second cylinder 410 through the common side connection pipe 530.

The suction pressure side connection pipe 510 is connected between a suction side of the second cylinder 410 and the second gas suction pipe SP2 of an inlet side of the accumulator 110.

The discharge pressure side connection pipe 520 can be connected to a lower portion of the casing 100 thereby to directly introduce oil inside the casing 100 into the vane pressure chamber 412, or can be diverged from a middle part of the gas discharge pipe DP. Herein, as the vane pressure chamber 412 becomes hermetic, oil may not be supplied between the second vane 440 and the second vane slot 411 and thus a frictional loss may be generated. Accordingly, an oil supply hole (not shown) is formed at the lower bearing 420 thereby to supply oil between the second vane 440 and the second vane slot 411 when the second vane 440 performs a reciprocation.

The vane restricting passage 413 is formed at the second cylinder 410, or the middle bearing 330 (FIG. 11A), or the lower bearing 420 (FIG. 11B) so that the vane restricting unit 500 can restrict the second vane 440 received in the second vane slot 411 by moving when a suction pressure is supplied to the vane chamber 412. Also, as shown in FIG. 5, a stopper 550 constructed as a stopper pin 551 or a pin spring 552 is installed at the second cylinder 410, or the middle bearing 330, or the lower bearing 420, so that the stopper pin 551 overcomes the pin spring 552 when a suction pressure is supplied to the vane chamber 412 and the second vane 440 is moved. Accordingly, the second vane 440 comes in contact with the middle bearing thereby to be restricted, or the second vane is directly restricted.

Unexplained reference numeral 541 denotes a valve housing, and 542 denotes a sliding valve.

An operation of the capacity variable double type rotary compressor according to the present invention will be explained.

When the rotor 220 is rotated as power is supplied to the stator 210 of the motor part 200, the rotation shaft 230 is rotated together with the rotor 220 thereby to transmit a rotation force of the motor part 200 to the first compression part 300 and the second compression part 400. When the first compression part 300 and the second compression part 400 are together normally driven, a cooling capacity of a large capacitance is generated. However, when the first compression part 300 performs a normal driving and the second compression part 400 performs a saving driving, a cooling capacity of a small capacitance is generated.

When the compressor or a refrigerating system using the same is normally driven, the sliding valve 542 is operated as shown in FIG. 3 thereby to block the suction pressure side connection pipe 510 and to connect the discharge pressure side connection pipe 520 to the common side connection pipe 530. Accordingly, oil or a refrigerant of a discharge pressure, a high pressure is supplied to the vane pressure chamber 412 of the second cylinder 410. As the result, the second vane 440 is moved towards the second rolling piston 430 by the pressure of the vane pressure chamber 412 thereby to be in contact with the second rolling piston 430, and normally compresses refrigerant gas introduced into the second compression space V2 and discharges the refrigerant gas. The refrigerant gas of a high pressure is supplied to the vane pressure chamber 412. However, since a sectional area of the vane restricting passage 413 is smaller than a sectional area of the second vane slot 411 in a radial direction, a pressurizing force of the vane pressure chamber 412 in a lateral direction is smaller than a pressurizing force of the vane pressure chamber 412 in back and forth directions. As the result, the second vane 440 is not restricted, and thus second vane 440 is continuously reciprocated in back and forth directions as the second rolling piston 430 performs an orbit motion. As shown in FIG. 5, even when the stopper 550 is installed, the vane chamber 412 maintains a discharge pressure, a high pressure. Therefore, both ends of the stopper pin 551 have the same pressure, and thus the stopper pin 551 does not restrict the second vane 440 by the pin spring 552.

The first vane 350 and the second vane 440 are respectively in contact with the rolling pistons 340 and 430 thereby to divide the first compression space V1 and the second compression space V2 into a suction chamber and a compression chamber. As the first vane 350 and the second vane 440 compress each refrigerant sucked into each suction chamber and discharge the refrigerant, the compressor or a refrigerating system using the same performs a driving of 100%.

On the contrary, when the compressor or the refrigerating system using the same performs a saving driving likewise the initial driving, as shown in FIG. 4, the slicing valve 542 of the pressure switching valve 540 is operated in an opposite manner to the normal driving. As the result, the suction pressure side connection pipe 510 and the common side connection pipe 530 are connected to each other, a refrigerant of a low pressure is introduced into the vane pressure chamber 412, and the second vane 440 is moved towards the vane pressure chamber 412 by a pressure of the second compression space V2 that is a relatively high pressure. Accordingly, the second vane 440 is separated from the second rolling piston 430, and thus the suction chamber and the compression chamber of the second compression space V2 are connected to each other. Therefore, a refrigerant sucked into the second compression space V2 is leaked to the suction chamber thereby not to be compressed, so that the second compression part 400 can not perform a compression operation. Oil or refrigerant gas of a high pressure is introduced into the vane restricting passage 413 provided at the second cylinder 410 thereby to restrict the second vane 440 in the second vane slot 411. As the result, the second vane 440 can not be moved under a separated state from the second rolling piston 430. As shown in FIG. 5, even when a stopper 550 is provided, the vane pressure chamber 412 maintains a suction pressure. As the result, the stopper pin 551 overcomes an elastic force of the stopper pin 551 by a pressure difference of both ends of the stopper pin 551 and thus moves towards the second vane 440, so that the second vane 440 comes in contact with the middle bearing 330 thereby to be restricted.

The compression chamber and the suction chamber of the second cylinder 410 are connected to each other, an entire refrigerant sucked into the suction chamber of the second cylinder 410 is not compressed but is sucked into the suction chamber along a locus of the rolling piston 430. As the result, the second compression part 400 does not perform a compression operation, so that the compressor or a refrigerating system using the same performs a driving corresponding to only the capacity of the first compression part 300.

Another embodiment for the vane restricting unit of the capacity varying type rotary compressor according to the present invention will be explained.

In the aforementioned embodiment, a suction pressure is supplied to the vane pressure chamber 412 under a state that the second vane 440 is received in the vane slot 411, thereby restricting the second vane by using a discharge pressure or a stopper. However, in the preferred embodiment, the second vane 440 is restricted by using a pressure difference between the compression space V2 of the second cylinder 410 and the vane pressure chamber 412.

Figure 6:
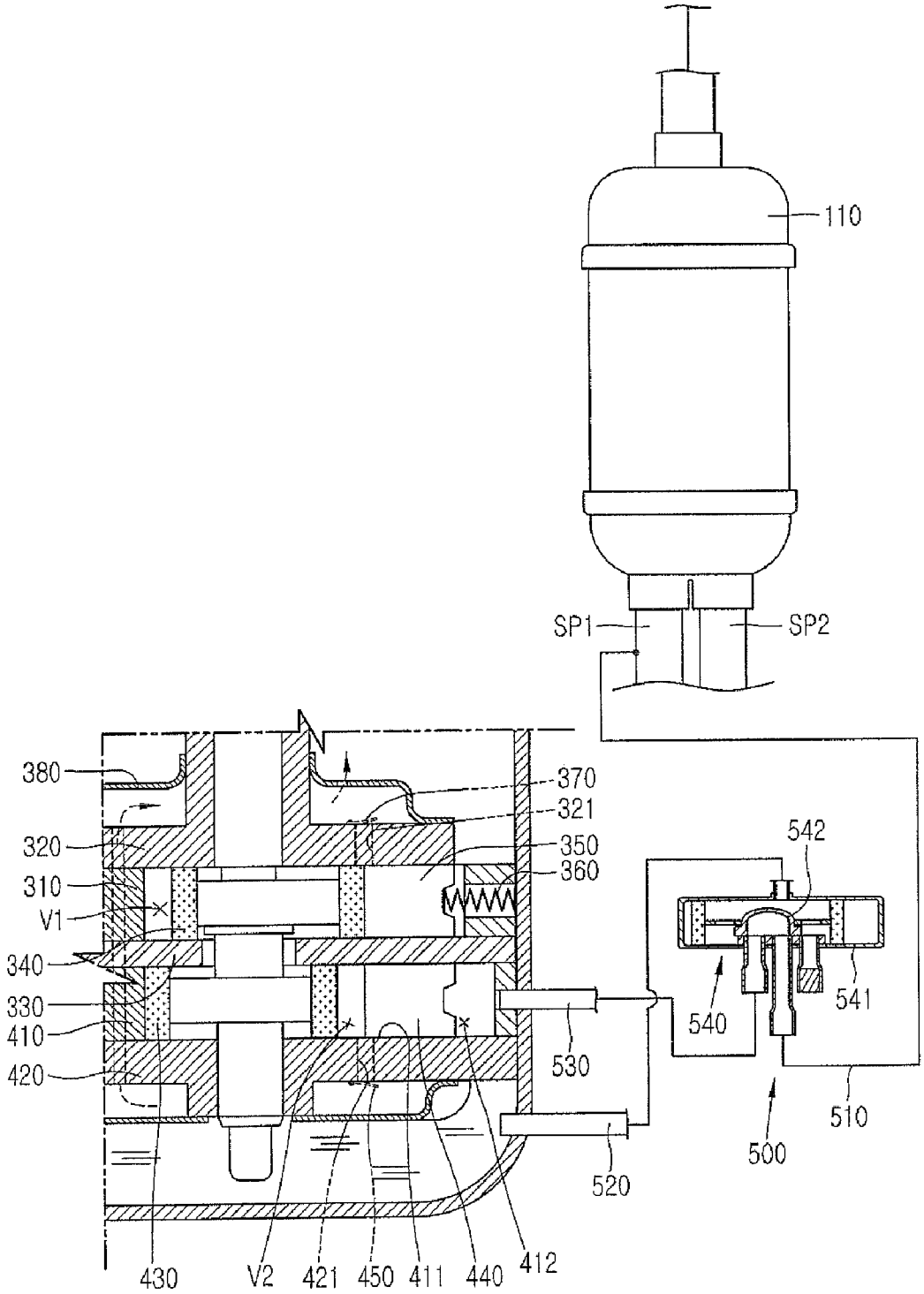
FIGS. 6 and 7 are longitudinal section views showing still another embodiment for restricting the vane of the capacity varying type rotary compressor according to the present invention, which show a process for restricting the vane.

The vane restricting unit 500 is constructed as follows. As shown in FIG. 6, when the second compression part 400 performs a saving driving by connecting the suction pressure side connection pipe 510 diverged from the first gas suction pipe SP1 to the common side connection pipe 530 connected to the vane pressure chamber 412, a suction pressure of the first compression part 300 that performs a normal driving is maintained to be equal to a pressure of the vane pressure chamber 412 of the second compression part 400.

Figure 7:
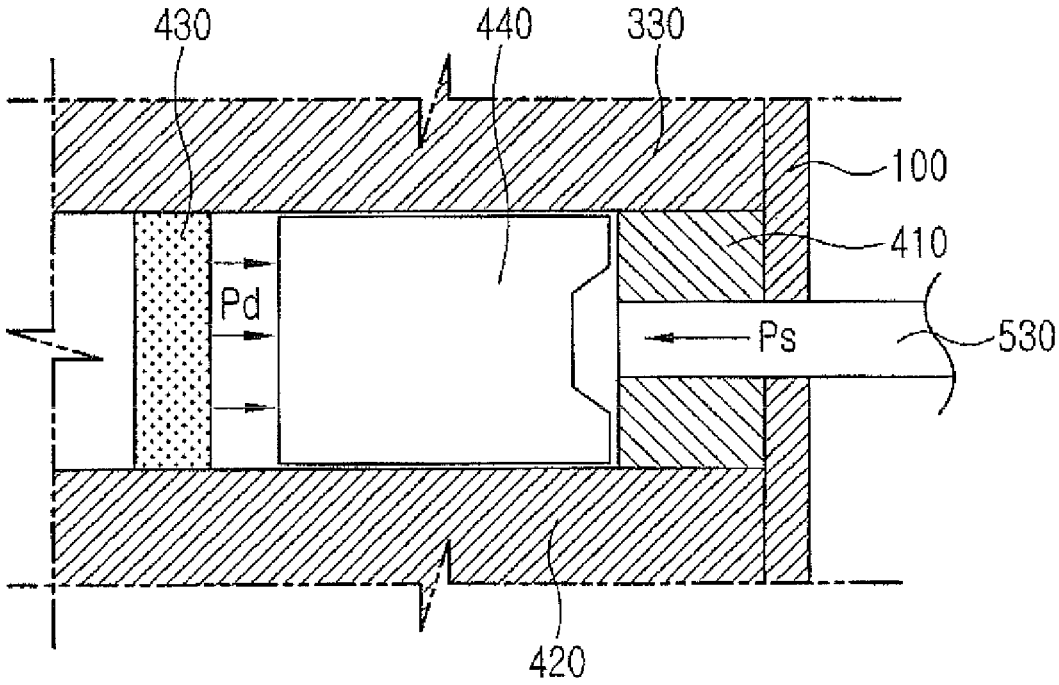

A refrigerant of a suction pressure is supplied to each compression space V1 and V2 of the first compression part 300 and the second compression part 400. However, as the vane pressure chamber 412 provided at the second compression part 400 maintains a suction pressure, the second vane 440 is moved towards inside of the vane pressure chamber 412. Accordingly, an idling is performed in the compression space V2 of the second compression part 400 with the refrigerant being leaked to the suction chamber from the compression chamber. As shown in FIG. 7, a refrigerant staying phenomenon is generated at the second gas suction pipe SP2 due to the refrigerant leakage generated from the compression space V2 of the second cylinder 410. Accordingly, the pressure inside the compression space V2 of the second cylinder 410 (approximately middle pressure Pb) becomes higher than the pressure inside the vane pressure chamber 412, that is, the suction pressure Ps of the first compression part 300, so that the second vane 440 maintains a received state into the second vane slot 411.

Then, when the discharge pressure side connection pipe 520 and the common side connection pipe 530 are connected to each other as the sliding valve 542 inside the pressure switching valve 540 is moved, the vane pressure chamber 412 of the second compression part 400 is in a high pressure thereby to have a pressure higher than the pressure inside the compression space V2 of the second cylinder 410. As the result, the second compression part 400 performs a normal driving under a state that the second vane 440 comes in contact with the second rolling piston 430.

Still another embodiment of the vane restricting unit of the capacity varying type rotary compressor according to the present invention will be explained as follows.

In the aforementioned embodiment, the vane pressure chamber 412 of the second compression part 400 is constructed as a hermetic space separated from the inner space of the casing 100. However, even when the vane pressure chamber 412 is constructed as an opened space by connecting the rear side of the second vane 440 to the inner space of the casing 100, the second vane 440 can be restricted by using a pressure difference.

Figure 8:
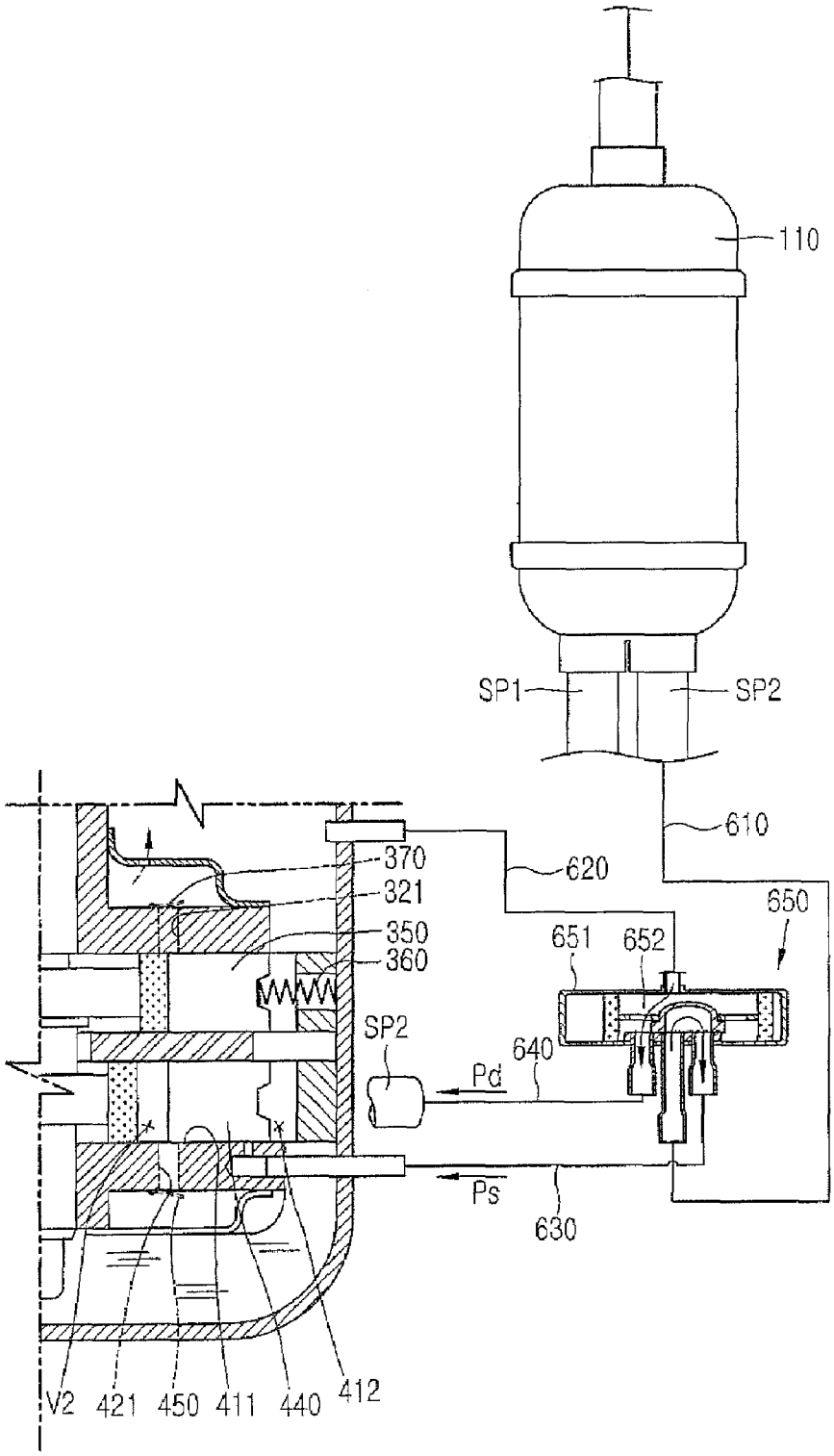
FIGS. 8 and 9 are longitudinal section views showing yet another embodiment for restricting the vane of the capacity varying type rotary compressor according to the present invention, which show a process for restricting the vane.

As shown in FIG. 8, the rear side of the second vane 440 of the second compression part 400 is connected to the inner space of the casing 100 so that the second vane 440 can be supported by a discharge pressure of the inner space of the casing 100. Also, a vane restricting passage 422 for restricting or releasing the second vane 440 by a pressure difference between the front side and the rear side of the second vane 440 is formed at the lower bearing (or the middle bearing) or the second cylinder 420. A suction pressure connection pipe 610, a discharge pressure side connection pipe 620, a common side connection pipe 630, and a cylinder side connection pipe 640 respectively for selectively supplying a sucked refrigerant or a discharged refrigerant to the vane restricting passage 422 and the compression space V2 of the second cylinder 410 are connected to a pressure switching valve 650.

The pressure switching valve 650 selectively connect four pipes one another as a sliding valve 652 slidably provided in a valve housing 651 having four pipes is operated by an electromagnet (not shown). A first pipe of the valve housing 651 is connected to the suction pressure side connection pipe 610 extending from the second gas suction pipe SP2, a second pipe is connected to the discharge pressure side connection pipe 620 connected to the inner space of the casing 100, a third pipe is connected to the common side connection pipe 630 connected to the vane restricting passage 422, and a fourth pipe is connected to the cylinder side connection pipe 640 connected to an inlet of the second cylinder 410.

The rear side of the second vane 440 is connected to the inner space of the casing 100, and thus oil is continuously supplied into the casing 100. Accordingly, the discharge pressure connection pipe, 640 may be installed to be higher than the oil surface so as to supply a refrigerant to the vane restricting passage 422.

The process for restricting the second vane in the capacity varying type rotary compressor of the present invention will be explained.

Figure 9:
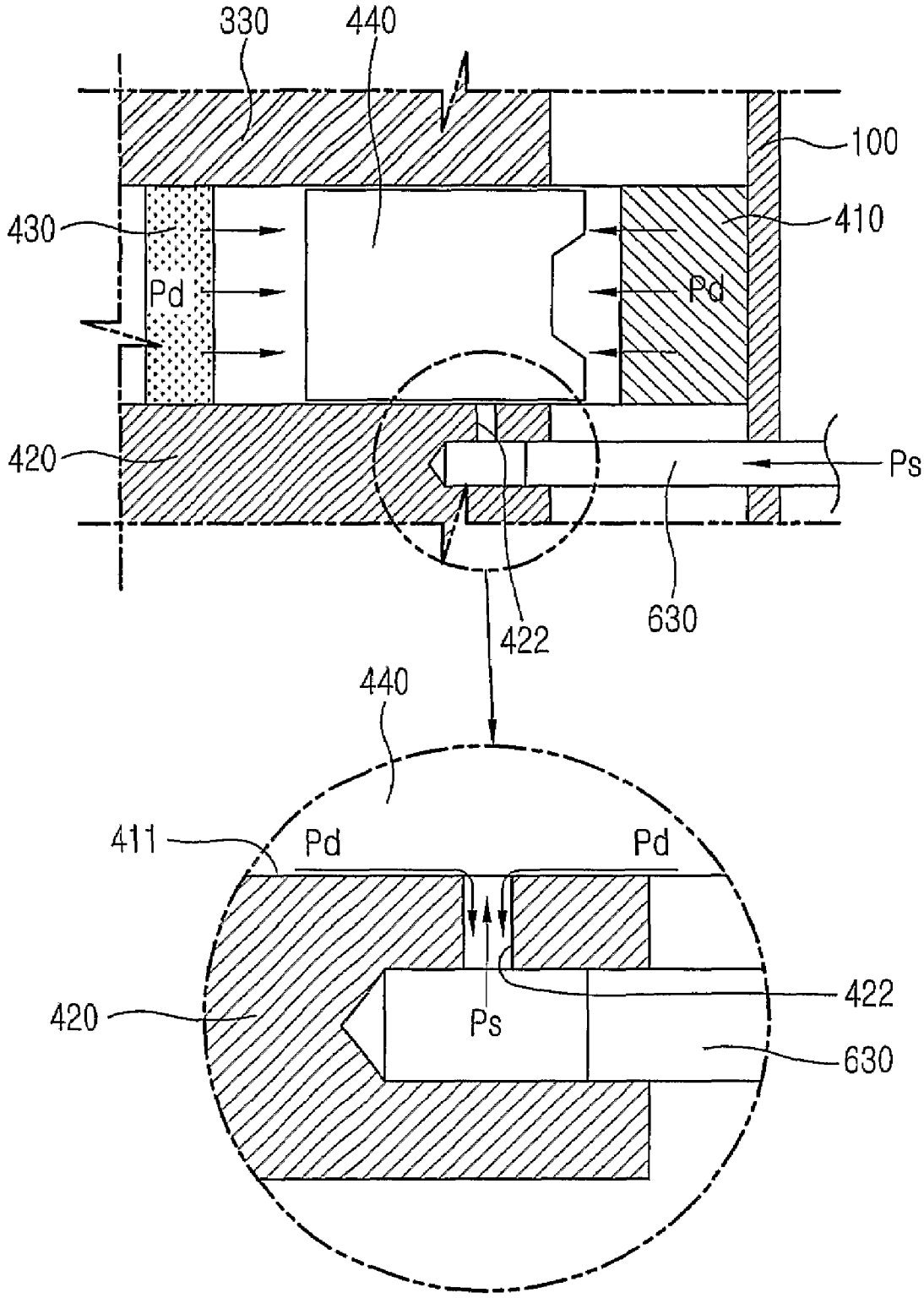

Once the sliding valve 652 of the pressures switching valve 650 is moved to connect the first pipe and the third pipe to each other, the rest second pipe and the fourth pipe are automatically connected to each other. Accordingly, the discharge pressure connection pipe 620 and the cylinder side connection pipe 640 are connected to each other, and thus a discharge pressure of a high pressure is supplied to the compression space V2 of the second cylinder 410. At the same time, the suction pressure connection pipe 610 and the common side connection pipe 630 are connected to each other, and thus a suction pressure of a low pressure is supplied to the vane restricting passage 422. As the result, the rear side of the second vane maintains a high pressure, that is the same as the pressure of the inner space of the casing 100, and the front side of the second vane 440, that is, the compression space V2 of the second cylinder 410 maintains a high pressure. Under the pressure equilibrium state, a low pressure is supplied to the lateral surface of the second vane 440. Accordingly, as shown in FIG. 9, the discharge pressure Pd of a high pressure formed at the front and rear sides of the second vane 440 is leaked to the suction pressure Ps of a low pressure, thereby intensively restricting the second vane 440.

On the contrary, when the sliding valve 652 of the pressures switching valve 650 is moved to connect the first pipe and the fourth pipe to each other and to connect the rest second pipe and the third pipe to each other, a refrigerant of a suction pressure is introduced into the compression space V2 of the second cylinder 410 and a discharge pressure of a high pressure is supplied to the vane restricting passage 422. As the result, the second vane 440 is moved towards the second rolling piston 430 by a pressure between the rear side and the front side thereof, and thus comes in contact with the second rolling piston 430 thereby to perform a normal driving.

Figure 10:
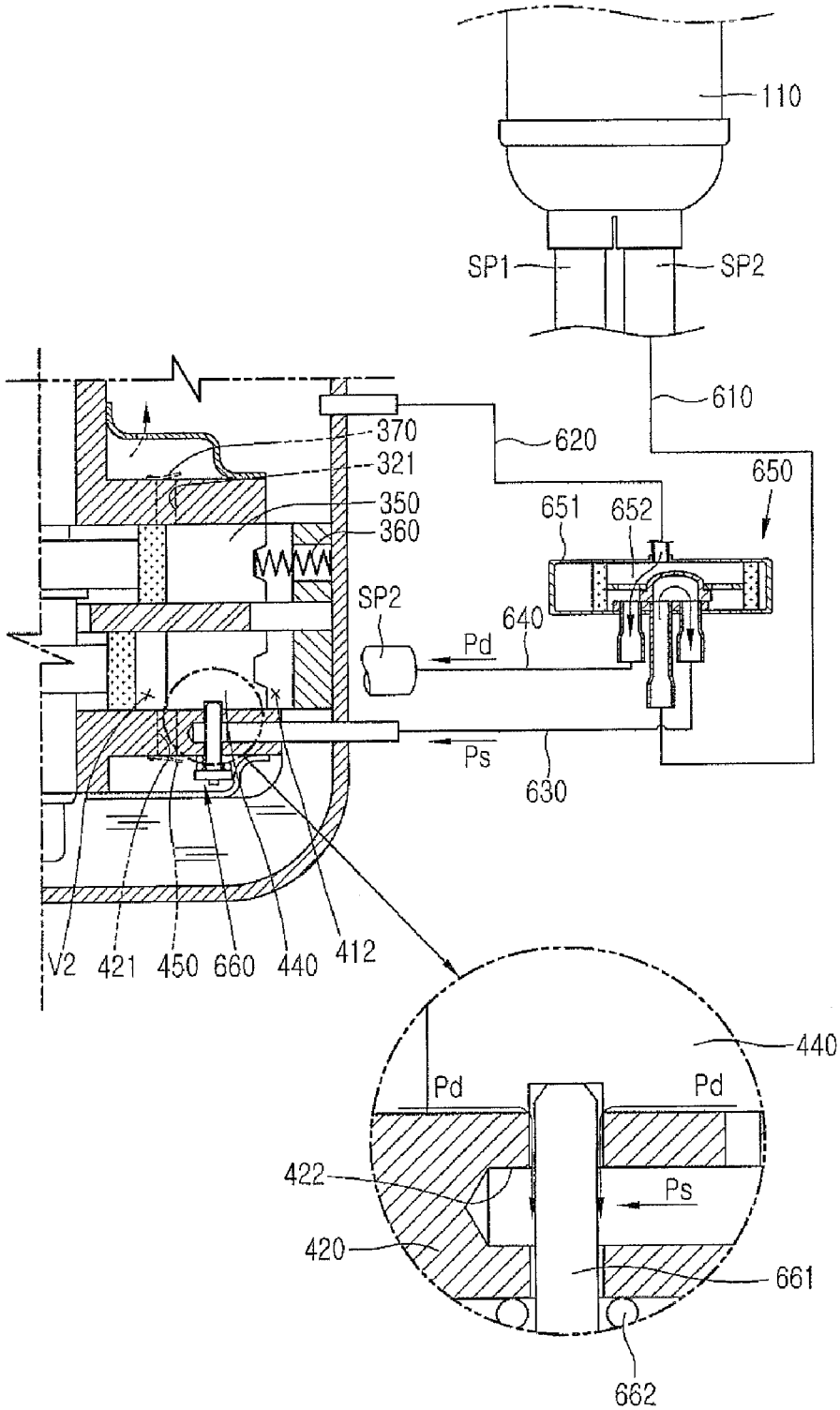
FIG. 10 is a longitudinal section view showing yet still another embodiment for restricting the vane of the capacity varying type rotary compressor according to the present invention.

As shown in FIG. 10, a stopper 660 constructed as a stopper pin 661 and a pin spring 662 is installed at the vane restricting passage 422, the second vane 440 can be more firmly restricted. That is, when a suction pressure is supplied to the vane restricting passage 422 by using the pressure switching valve 650, resultant force between a pressure of the vane restricting passage 422 and an elastic force of the pin spring 661 is less than force by a pressure of the inner space of the casing 100. As the result, the stopper pin 661 is pressed towards the second vane 440 thereby to restrict the second vane 440. On the contrary, when a discharge pressure is supplied to the vane restricting passage 422, the stopper pin 661 is moved by the elastic force of the pin spring 662 thereby to release the restriction of the second vane 440.

In the preferred embodiment of the present invention, the vane restricting passage is installed at one cylinder assembly of the rotary compressor having a plurality of cylinder assemblies. However, the vane restricting passage can be installed at each cylinder assembly, and the vane restricting passage can be applied to a single type rotary compressor having one cylinder assembly.

In the capacity varying type rotary compressor according to the present invention, the vane is restricted by using a pressure difference between the rear side and the front side thereof and a pressure difference between the lateral sides thereof. Therefore, the entire structure is simplified thereby to minimize processing assemblies, resulting in reducing a production cost and enhancing a productivity. Furthermore, as the vane is restricted by using the pressure difference of the system, a reliability is enhanced. Especially, in case of using the stopper, the reliability of the product can be more enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity varying rotary compressor, comprising:

a casing that maintains a discharge pressure state;

a motor installed in the casing and generating a driving force; and at least one cylinder assembly that includes:

a rolling piston;

a vane, wherein the rolling piston is eccentrically coupled to a rotation shaft of the motor such that the rolling piston performs an orbiting motion and the vane performs a linear motion relative to the rolling piston;

a vane restricting device that restricts a position of the vane so as to separate the vane from the rolling piston, or so as to release the vane so that the vane contacts the rolling piston; and a vane chamber formed at a rear side of the vane, wherein the vane restricting device restricts or releases the vane based on a pressure differential applied to the vane in the vane chamber, and wherein a suction pressure is supplied to the vane chamber so as to separate the vane from the rolling piston, and wherein a high discharge pressure is applied to at least one of two opposite lateral side surfaces of the vane, or to a lower end surface of the vane, so as to restrict a position of the vane.

2. The rotary compressor of claim 1, wherein the discharge pressure applied to the lateral side surfaces of the vane or to the lower end surface of the vane is applied by oil contained in the casing.

3. A capacity varying rotary compressor, comprising:

a casing that maintains a discharge pressure state;

a motor installed in the casing and generating a driving force; and at least one cylinder assembly that includes:

a rolling piston;

a vane, wherein the rolling piston is eccentrically coupled to a rotation shaft of the motor such that the rolling piston performs an orbiting motion and the vane performs a linear motion relative to the tolling piston;

a vane restricting device that restricts a position of the vane so as to separate the vane from the rolling piston, or so as to release the vane so that the vane contacts the rolling piston;

a vane chamber formed at a rear side of the vane, wherein the vane restricting device restricts or releases the vane based on a pressure differential applied to the vane in the vane chamber and wherein a suction pressure is supplied to the vane chamber so as to separate the vane from the rolling piston, and wherein the discharge pressure is applied to at least one of a forward lateral surface or a rear lateral surface of the vane.

4. A capacity varying rotary compressor, comprising:

a casing that maintains a discharge pressure state;

a motor installed in the casing and generating a driving force; and at least one cylinder assembly that includes:

a rolling piston;

a vane, wherein the rolling piston is eccentrically coupled to a rotation shaft of the motor such that the rolling piston performs an orbiting motion and the vane performs a linear motion relative to the rolling piston;

a vane restricting device that restricts a position of the vane so as to separate the vane from the rolling piston, or so as to release the vane so that the vane contacts the rolling piston, wherein:

the vane restricting device restricts or releases the vane based on a pressure differential applied to the vane in a vane chamber, a rear lateral surface of the vane connected to an inner space of the casing such that the vane is supported by a discharge pressure, and a low pressure is supplied to at least one of two opposite lateral side surfaces of the vane, or to at least one of an upper end surface or a lower end surface of the vane so as to restrict a position of the vane.

5. A capacity varying rotary compressor, comprising:

a casing that maintains a discharge pressure state;

a motor installed in the casing and generating a driving force; and at least one cylinder assembly that includes:

a rolling piston;

a vane, wherein the rolling piston is eccentrically coupled to a rotation shaft of the motor such that the rolling piston performs an orbiting motion and the vane performs a linear motion relative to the rolling piston;

a vane restricting device that restricts a position of the vane so as to separate the vane from the rolling piston, or so as to release the vane so that the vane contacts the rolling piston, wherein the vane restricting device restricts or releases the vane based on a pressure differential applied to the vane;

a vane chamber formed at a rear side of the vane, wherein:

a suction pressure is supplied to the vane chamber so as to separate the vane from the rolling piston, a vane pressure chamber of the at least one cylinder assembly that performs a saving driving operation has the same pressure as a suction pressure of a cylinder assembly of the plurality of cylinder assemblies that performs a normal driving operation, and a high discharge pressure is supplied to at least one of two opposite lateral side surfaces of the vane, or to a lower end surface of the vane, so as to restrict a position of the vane.

6. A capacity varying rotary compressor, comprising:

a casing that maintains a discharge pressure state;

a motor installed in the casing and generating a driving force; and at least one cylinder assembly that includes:

a rolling piston;

a vane, wherein the rolling piston is eccentrically coupled to a rotation shaft of the motor such that the rolling piston performs an orbiting motion and the vane performs a linear motion relative to the rolling piston; and a vane restricting device that restricts a position of the vane so as to separate the vane from the rolling piston, or so as to release the vane so that the vane contacts the rolling piston, wherein the vane restricting device restricts or releases the vane based on a pressure differential applied to the vane in a vane chamber, wherein a rear lateral surface of the vane contacts and inner surface of the casing such that the vane is supported by a discharge pressure, and wherein one of a suction pressure or a discharge pressure is supplied to an inlet of the at least one cylinder assembly, and the other of the suction pressure or the discharge pressure is supplied to opposite lateral side surfaces of the vane, or upper and lower end surfaces of the vane so as to hold or release the vane.

* * * * *